US010290963B2

(12) United States Patent
Liao

(10) Patent No.: US 10,290,963 B2
(45) Date of Patent: May 14, 2019

(54) U-SHAPED ELECTRICAL SOCKET

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/842,860

(22) Filed: Dec. 14, 2017

(65) Prior Publication Data

US 2018/0166810 A1 Jun. 14, 2018

(30) Foreign Application Priority Data

Dec. 14, 2016 (CN) ..... 2016 2 1373783 U

(51) Int. Cl.

| | |
|---|---|
| ***H01R 12/71*** | (2011.01) |
| ***H01R 13/40*** | (2006.01) |
| *H01R 12/70* | (2011.01) |
| *H01R 13/24* | (2006.01) |

(52) U.S. Cl.

CPC ..... *H01R 12/716* (2013.01); *H01R 13/40* (2013.01); *H01R 12/7076* (2013.01); *H01R 12/714* (2013.01); *H01R 13/2435* (2013.01)

(58) Field of Classification Search

CPC ..... H01R 13/42; H01R 12/716; H01R 13/40
USPC ..... 439/626, 62
See application file for complete search history.

(56) References Cited

U.S. PATENT DOCUMENTS

| | | | | |
|---|---|---|---|---|
| 4,511,201 A * | 4/1985 | Baker | H05K 7/1069 | 439/260 |
| 5,751,556 A * | 5/1998 | Butler | H01R 12/57 | 174/250 |
| 5,885,101 A * | 3/1999 | Matsuoka | H01L 23/32 | 439/526 |
| 6,679,707 B1 * | 1/2004 | Brodsky | H05K 3/325 | 361/760 |
| 7,517,256 B2 * | 4/2009 | Chang | H01R 13/518 | 439/701 |

(Continued)

FOREIGN PATENT DOCUMENTS

| | | |
|---|---|---|
| TW | M349082 | 1/2009 |
| TW | M241823 | 8/2014 |

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

The connector includes an insulative housing having a frame configuration, and a plurality of contacts disposed in the housing. The electronic package includes an upper part and a lower part extending downwardly from the upper part. The upper part includes on a peripheral region a flange extending beyond the lower part laterally. The housing include a bar unit with an opening, and a receiving space defined in the bar unit. The bar unit forms opposite upper surface and lower surface thereof. The contacts includes a first contacting section extending upwardly above the upper surface and a second contacting section extending downwardly below the lower surface. The lower part is restrained in the receiving space while he flange is seated upon the housing.

20 Claims, 7 Drawing Sheets

(56) References Cited

U.S. PATENT DOCUMENTS

| | | | | |
|---|---|---|---|---|
| 7,819,669 | B2 * | 10/2010 | Liao | H01R 31/08 439/66 |
| 7,883,352 | B2 * | 2/2011 | Taguchi | H01R 13/2442 439/331 |
| 8,221,135 | B2 * | 7/2012 | Chang | H05K 7/1053 439/71 |
| 8,267,701 | B2 * | 9/2012 | Beaman | H01L 23/4006 439/68 |
| 9,124,011 | B2 * | 9/2015 | Miyazaki | H01R 12/716 |
| 9,356,368 | B2 * | 5/2016 | Chang | H01R 12/707 |
| 9,368,890 | B1 * | 6/2016 | Liao | H01R 12/7082 |
| 2008/0153322 | A1 * | 6/2008 | Liao | H05K 7/1069 439/68 |

* cited by examiner

U-SHAPED ELECTRICAL SOCKET

FIELD OF THE DISCLOSURE

The invention is related to an electrical connector, and particularly to the electrical connector with a frame structure mounted upon a PCB (Printed Circuit Board) to receive an electronic package therein.

DESCRIPTION OF RELATED ARTS

Taiwan patent M241823 discloses a square type socket including a matrix type contacts therein to mate with the square type CPU (Central Processing Unit) with the matrix type conductors thereof. Notably, the configuration of the socket seems dull, thus tending not to be minimized. U.S. Pat. Nos. 6,390,827 and 8,398,410 show the square type socket equipped with the contact on a peripheral region.

It is desired to provide an electrical connector with a frame structure with an central opening to allow the CPU to directly downwardly face the PCB in the central region and electrically connected to the PCB via the connector.

SUMMARY OF THE DISCLOSURE

To achieve the above desire, an electrical connector assembly includes an electrical connector and an electronic package. The connector includes an insulative housing having a frame configuration, and a plurality of contacts disposed in the housing. The electronic package includes an upper part and a lower part extending downwardly from the upper part. The upper part includes on a peripheral region a flange extending beyond the lower part laterally, and the undersurface of the flange includes a plurality of conductive pads while that of the upper part does not. The housing include a bar unit with an opening, and a receiving space defined in the bar unit. The bar unit forms opposite upper surface and lower surface thereof. The contacts includes a first contacting section extending upwardly above the upper surface and a second contacting section extending downwardly below the lower surface. The lower part is restrained in the receiving space. The flange is seated upon the bar unit so as to have the first contacting sections of the contacts are downwardly pressed by the conductive pads, respectively.

DETAILED DESCRIPTION OF THE PREFERRED EMBODIMENT

Figure 1:
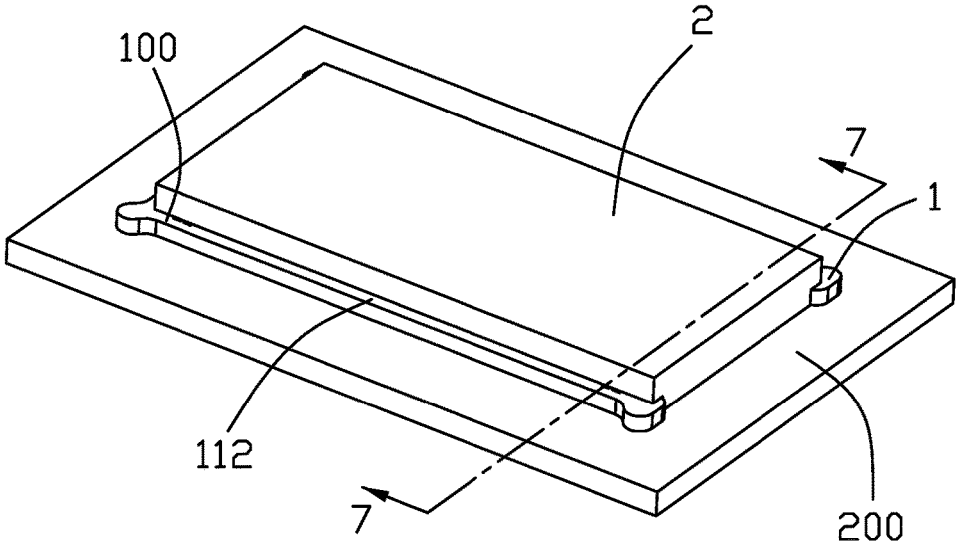
FIG. 1 is a front downward perspective view of an electrical connector assembly mounted upon the printed circuit board according to the invention.
Figure 2:
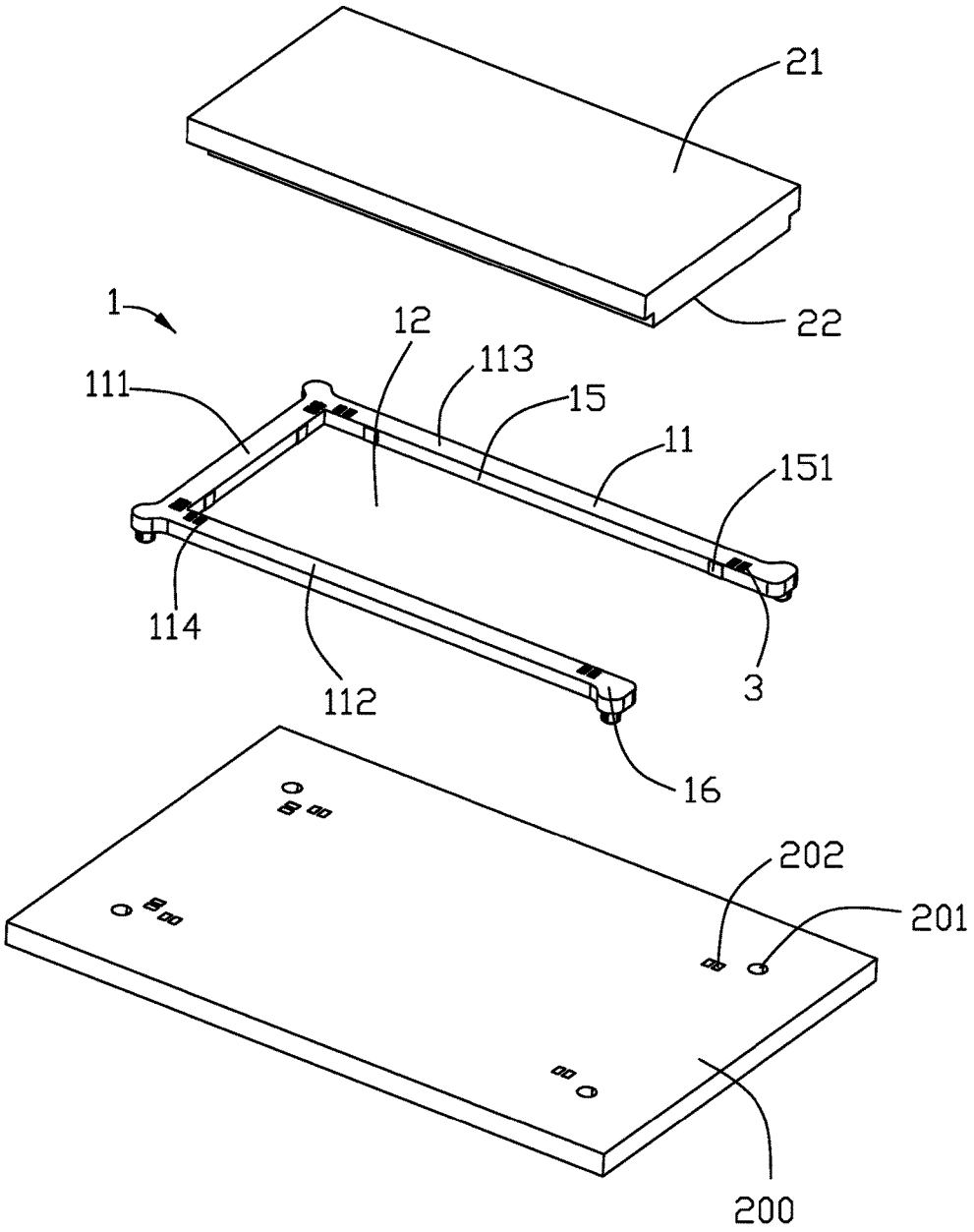
FIG. 2 is a front downward exploded perspective view of the electrical connector assembly of FIG. 1.
Figure 3:
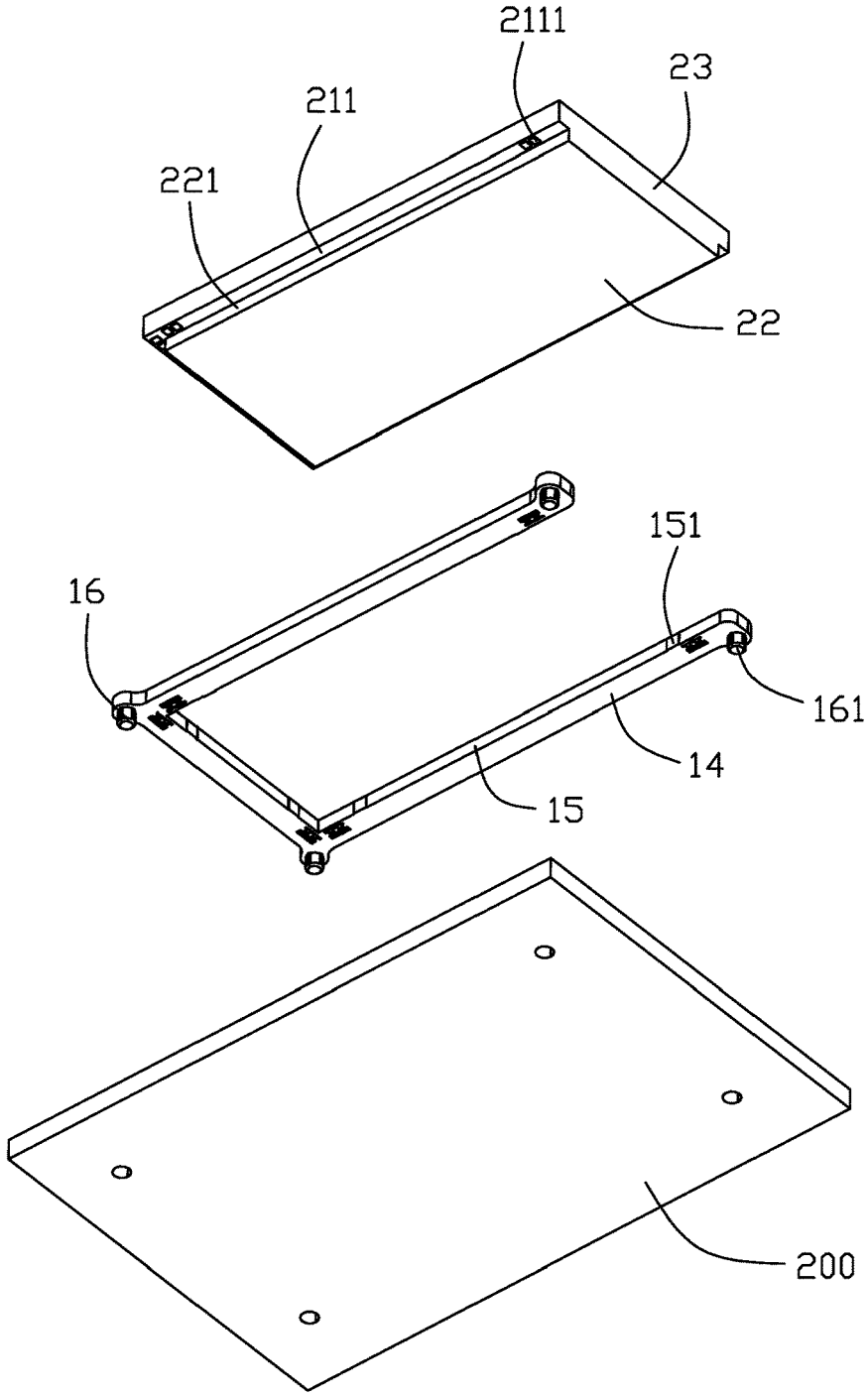
FIG. 3 is an upward exploded perspective view of the electrical connector assembly of FIG. 1.
Figure 4:
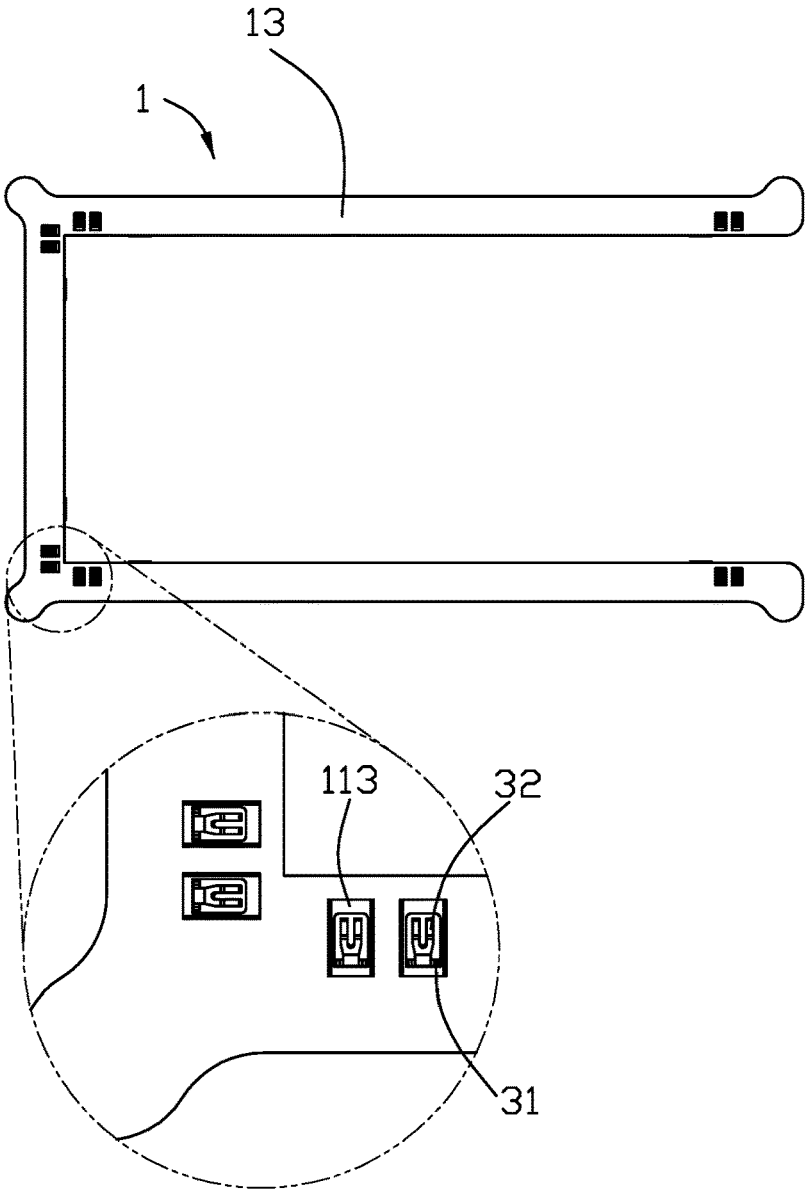
FIG. 4 is a to top view of the electrical connector of the electrical connector assembly of FIG. 1.
Figure 5:
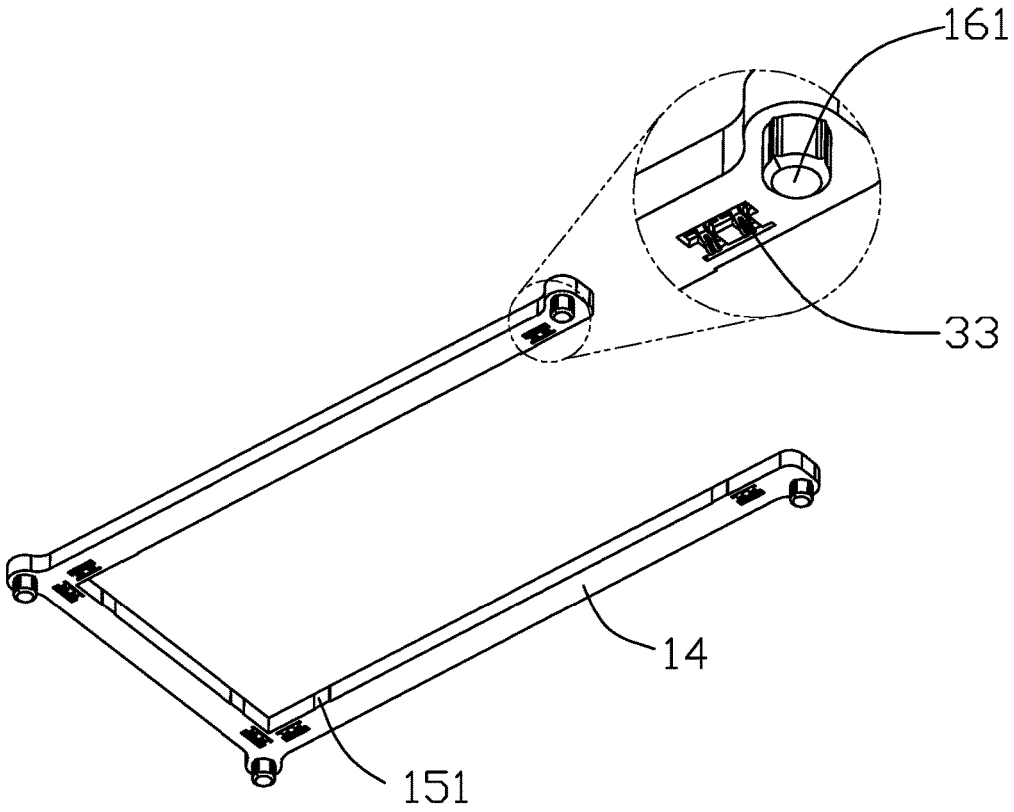
FIG. 5 is an upward exploded perspective view of the electrical connector of the electrical connector assembly of FIG. 1.
Figure 6:
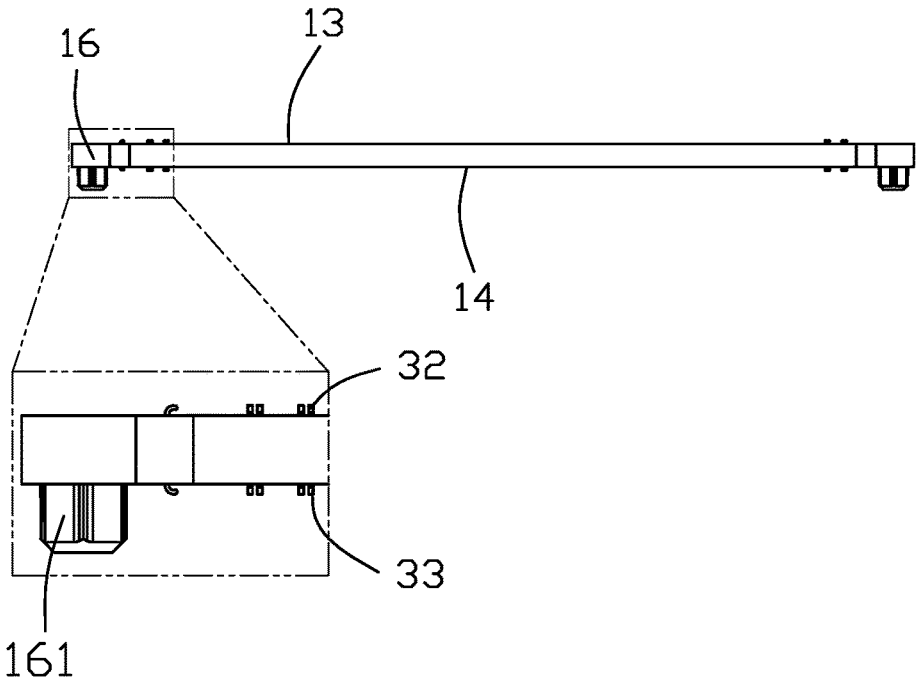
FIG. 6 is a side view of the electrical connector of the electrical connector assembly of FIG. 1.
Figure 7:
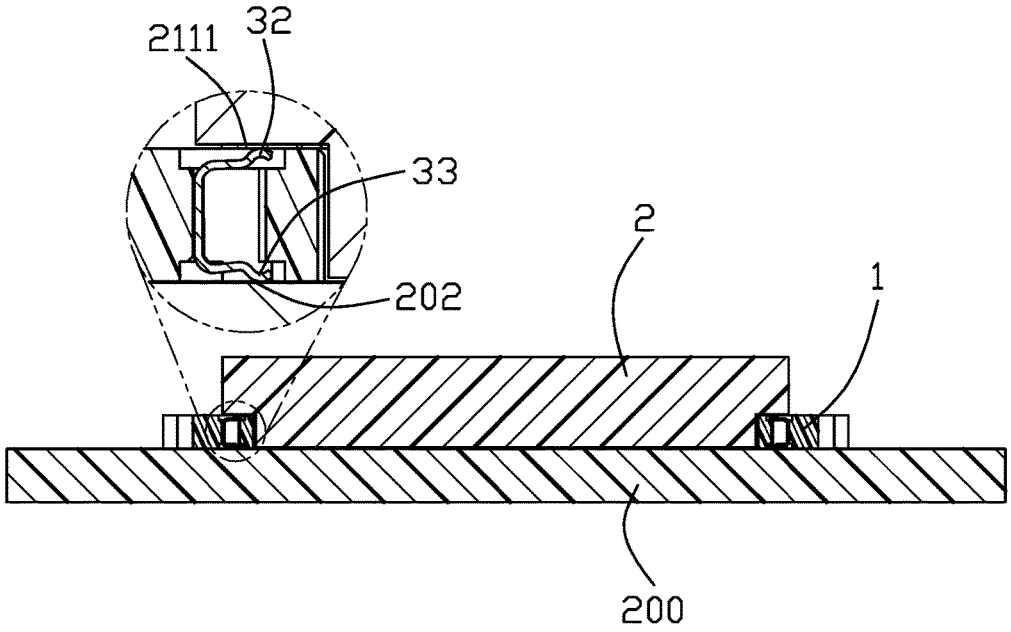
FIG. 7 is a cross-sectional view of the electrical connector assembly of FIG. 1.

Reference will now be made in detail to the embodiments of the present disclosure. Referring to FIGS. 1-7, an electrical connector assembly 100 for mounting to a printed circuit board 200, includes an electrical connector 1 and a CPU or electronic package 2 therein. The electrical connector 1 includes an insulative housing 11 and a plurality of contacts 3 disposed in the housing 11.

The insulative housing 11 includes a bar unit with an opening communicating with an exterior in a horizontal direction, and a receiving space 12 in the bar unit. The bar unit defines an upper surface 13 and a lower surface 14 with an inner surface 15 located between the upper surface 13 and the lower surface 14 in a vertical direction and facing the receiving space 12 transversely. The bar unit includes a first bar 111, and a second bar 112 and a third bar 113 opposite to each other in the transverse direction and extending in a front-to-back direction from two opposite transverse ends of the first bar 111 in the transverse direction. An opening is formed between the second bar 112 and the third bar 113 opposite to the first bar 111 in the front-to-back direction, and said opening rearwardly communicates, in the front-to-back direction, with the receiving space 12 which is formed among the first bar 111, the second bar 112 and the third bar 113, and communicates with an exterior in the front-to-back direction through the opening. The bar unit forms a plurality of passageways 114 extending through the upper surface 13 and the lower surface 14 and spaced from one another transversely. The joints between the first bar 111 and the second bar 112 and the third bar 113, and distal ends of the second bar 112 and the third bar 113, form corresponding round protrusions 16. Each round protrusion 16 forms a positioning post 161 thereunder for extending into the corresponding positioning hole 201 in the PCB 200. The inner surface 15 forms a plurality of bumps 151 for retaining the CPU 2.

The contact 3 includes a retaining section 31 retaining the contact 3 within the corresponding passageway 114, a first/upper contacting section 32 extending from a top end of the retaining section 31 and upwardly above the upper surface 13, and a second/lower contacting section 33 extending from a bottom end of the retaining section 31 and downwardly below the lower surface 14. The first contacting sections 32 on the first bar 111 extend along the front-to-back direction while the those on the second bar 112 and the third bar 113 extend in the transverse direction perpendicular to the front-to-back direction wherein the first contacting sections 32 on the second bar 112 extend opposite to those on the third bar 113 in the transverse direction. The second contacting sections 33 are symmetrically arranged with regard to the first contacting sections 32, respectively. In brief, all the first contacting section 32 and the second contacting sections 33 extend toward the receiving space 12. Understandably, the contacts 3 may be arranged with one row on each bar instead only at two opposite ends thereof.

The CPU 2 includes an upper part 21 and a lower part 22, which is adapted to be received within the receiving space 12, commonly showing a T-shaped cross-section or end face 23. The outer surface 221 of the lower part 22 is perpendicular to the undersurface of the upper part 21, and is retained with the bumps 151 on the inner surface 15. Three flanges 211 are formed as one flange unit on the U-shaped peripheral region of the upper part 21. The conductive pads 2111 are located on an undersurface of the flanges 211 for mating with the first contacting sections 32 of the contacts 3. Correspondingly, a plurality of conductive pads 202 are formed upon the printed circuit board 200 for mating with the second contacting sections 33 of the contacts 3.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector for use with an electronic package, comprising:

an insulative housing forming a frame structure thereof, and defining opposite upper surface and lower surface in a vertical direction, and a receiving space therein in a central region along said vertical direction, said housing including at least a first bar extending along a transverse direction perpendicular to the vertical direction, and a second bar linked to one end of the first bar and extending along a front-to-back direction perpendicular to both the vertical direction and the transverse direction; and a plurality of contacts disposed in each of the first bar and the second bar of the housing, each of the contacts including a retaining section retained to the housing, a resilient upper contacting section extending from the retaining section above the upper surface of the housing, and a resilient lower contacting section extending from the retaining section below the lower surface; wherein in a top view, all the upper contacting sections and all the lower contacting sections extend toward the receiving space along either the front-to-back direction or the transverse direction; wherein the frame structure is of a U-shaped configuration in the top view to have an additional third bar linked to another end of the first bar and extends in the front-to-back direction and parallel to the second bar; wherein an opening is formed between distal ends of the second bar and the third bar opposite to the first bar, and the receiving space communicates with an exterior in the front-to-back direction through the opening.

2. The electrical connector as claimed in claim 1, wherein in the top view, each of the first bar, the second bar and the third bar forms a pair of protrusions at two opposite ends, and each of said protrusion is equipped with a positioning post on an underside thereof.

3. The electrical connector as claimed in claim 1, wherein each of the first bar, the second bar and the third bar includes an inner surface facing the receiving space, and each inner surface forms at least one bump thereon for retaining the electronic package in the receiving space.

4. An electrical connector assembly comprising:

an electronic package including an upper part and a lower part, the upper part forming a flange unit on a peripheral region, a plurality of conductive pads formed on an undersurface of the flange unit;

an electrical connector including:

an insulative housing forming a frame structure thereof, and defining opposite upper surface and lower surface in a vertical direction, and a receiving space therein in a central region along said vertical direction, said housing including at least a first bar extending along a transverse direction perpendicular to the vertical direction, and a second bar linked to one end of the first bar and extending along a front-to-back direction perpendicular to both the vertical direction and the transverse direction; and a plurality of contacts disposed in each of the first bar and the second bar of the housing, each of the contacts including a retaining section retained to the housing, a resilient upper contacting section extending from the retaining section above the upper surface of the housing, and a resilient lower contacting section extending from the retaining section below the lower surface; wherein the lower part is received within the receiving space, and the flange unit is located upon the housing with the conductive pads mechanically and electrically connected with the upper contacting sections of the corresponding contacts, respectively, in the vertical direction; wherein said electronic package has a T-shaped end face, and the receiving space communicates with an exterior along the front-to-back direction to expose said T-shaped end face to the exterior in said front-to-back direction.

5. The electrical connector assembly as claimed in claim 4, wherein in a top view, all the upper contacting sections and all the lower contacting sections extend toward the receiving space along either the front-to-back direction or the transverse direction.

6. The electrical connector assembly as claimed in claim 5, wherein the frame structure is of a U-shaped configuration in the top view to have an additional third bar linked to the other end of the first bar and extends in the front-to-back direction and parallel to the second bar.

7. The electrical connector assembly as claimed in claim 6, wherein in the top view, each of the first bar, the second bar and the third bar forms a pair of protrusions at two opposite ends, and each of said protrusion is equipped with a positioning post on an underside thereof.

8. The electrical connector assembly as claimed in claim 6, wherein each of the first bar, the second bar and the third bar includes an inner surface facing the receiving space, and each inner surface forms at least one bump thereon for retaining the electronic package in the receiving space.

9. The electrical connector assembly as claimed in claim 5, further including a printed circuit board on which the electrical connector is mounted, wherein said printed circuit board forms a plurality of conductive pads aligned, in the vertical direction, with and mechanically and electrically connected to the lower contacting sections of the contacts.

10. The electrical connector assembly as claimed in claim 9, wherein in said top view, each of the first bar and the second bar has pair of protrusions at two opposite ends, and each of said protrusions is equipped with a positioning post on an undersurface, and the printed circuit board forms a plurality of positioning holes receiving said positioning posts, respectively.

11. The electrical connector assembly as claimed in claim 9, wherein the lower part of the electronic package directly and communicatively faces downward toward the printed circuit board.

12. The electrical connector assembly as claimed in claim 4, wherein said flange unit is of an U-shaped configuration.

13. An electrical connector assembly comprising:

an electronic package including an upper part and a lower part, the upper part forming a flange unit on a peripheral region, a plurality of conductive pads formed on an undersurface of the flange unit;

an electrical connector including:

an insulative housing forming a frame structure thereof, and defining opposite upper surface and lower surface in a vertical direction, and a receiving space therein in a central region along said vertical direction, said housing including at least a first bar extending along a transverse direction perpendicular to the vertical direction, and a second bar linked to one end of the first bar and extending along a front-to-back direction perpendicular to both the vertical direction and the transverse direction; and a plurality of contacts disposed in each of the first bar and the second bar of the housing, each of the contacts including a retaining section retained to the housing, a resilient upper contacting section extending from the retaining section above the upper surface of the housing, and a resilient lower contacting section extending from the retaining section below the lower surface; wherein the lower part is received within the receiving space, and the flange unit is located upon the housing with the conductive pads mechanically and electrically connected with the upper contacting sections of the corresponding contacts, respectively, in the vertical direction; wherein the upper part of the electronic package is exposed to an exterior in both the transverse direction and the front-to-back direction.

14. The electrical connector assembly as claimed in claim 13, wherein the frame structure is of a U-shaped configuration in the top view to have an additional third bar linked to the other end of the first bar and extends in the front-to-back direction and parallel to the second bar.

15. The electrical connector assembly as claimed in claim 14, wherein in the top view, each of the first bar, the second bar and the third bar forms a pair of protrusions at two opposite ends, and each of said protrusion is equipped with a positioning post on an underside thereof.

16. The electrical connector assembly as claimed in claim 14, wherein each of the first bar, the second bar and the third bar includes an inner surface facing the receiving space, and each inner surface forms at least one bump thereon for retaining the electronic package in the receiving space.

17. The electrical connector assembly as claimed in claim 14, further including a printed circuit board on which the electrical connector is mounted, wherein said printed circuit board forms a plurality of conductive pads aligned, in the vertical direction, with and mechanically and electrically connected to the lower contacting sections of the contacts.

18. The electrical connector assembly as claimed in claim 17, wherein in said top view, each of the first bar and the second bar has pair of protrusions at two opposite ends, and each of said protrusions is equipped with a positioning post on an undersurface, and the printed circuit board forms a plurality of positioning holes receiving said positioning posts, respectively.

19. The electrical connector assembly as claimed in claim 13, wherein all the upper surface of the housing lies at a same horizontal level.

20. The electrical connector assembly as claimed in claim 13, wherein said flange unit is of an U-shaped configuration.

* * * * *